US006216978B1

(12) United States Patent
Rodriguez

(10) Patent No.: US 6,216,978 B1
(45) Date of Patent: Apr. 17, 2001

(54) TAPE DISPENSING DEVICE

(76) Inventor: Alexander Rodriguez, 37 N. 9th St., Apt. 2, Newark, NJ (US) 07107

( * ) Notice: Subject to any disclaimer, the term of this patent is extended or adjusted under 35 U.S.C. 154(b) by 0 days.

(21) Appl. No.: 09/301,882

(22) Filed: Apr. 29, 1999

Related U.S. Application Data

(63) Continuation-in-part of application No. 09/072,040, filed on May 4, 1998, which is a continuation-in-part of application No. 08/818,925, filed on Mar. 17, 1997, now abandoned, which is a continuation-in-part of application No. 08/546,815, filed on Oct. 23, 1995, now abandoned.

(51) Int. Cl.[7] ..... B65D 85/02

(52) U.S. Cl. ..... 242/588.1; 242/58; 242/588.6; 242/596.3

(58) Field of Search ..... 242/580, 588, 242/588.1, 588.6, 597.4, 596.3

(56) References Cited

U.S. PATENT DOCUMENTS

| | | | | |
|---|---|---|---|---|
| 1,177,636 | * | 4/1916 | Kuehn | 242/588 |
| 2,525,992 | * | 10/1950 | Wynn | 242/588.1 |
| 3,086,723 | * | 4/1963 | Meeks | 242/588 |
| 4,732,340 | * | 3/1988 | Toya | 242/596.3 |
| 5,735,400 | * | 4/1998 | Packard | 242/588.6 |
| 6,012,674 | * | 1/2000 | Leeuwenburgh | 242/588.6 |

* cited by examiner

*Primary Examiner*—Donald P. Walsh
*Assistant Examiner*—William A. Rivera

(57) ABSTRACT

A compound tape dispensing device comprised of a belt attachment portion. A tape holding portion is secured to the belt attachment portion. A tape retaining portion is secured to the tape holding portion to hold a roll of compound tape thereon. An unwinding prevention portion is included to preclude the roll of compound tape from unrolling by applying pressure on a circumferential face of the roll of compound tape.

12 Claims, 11 Drawing Sheets

FIG. 7
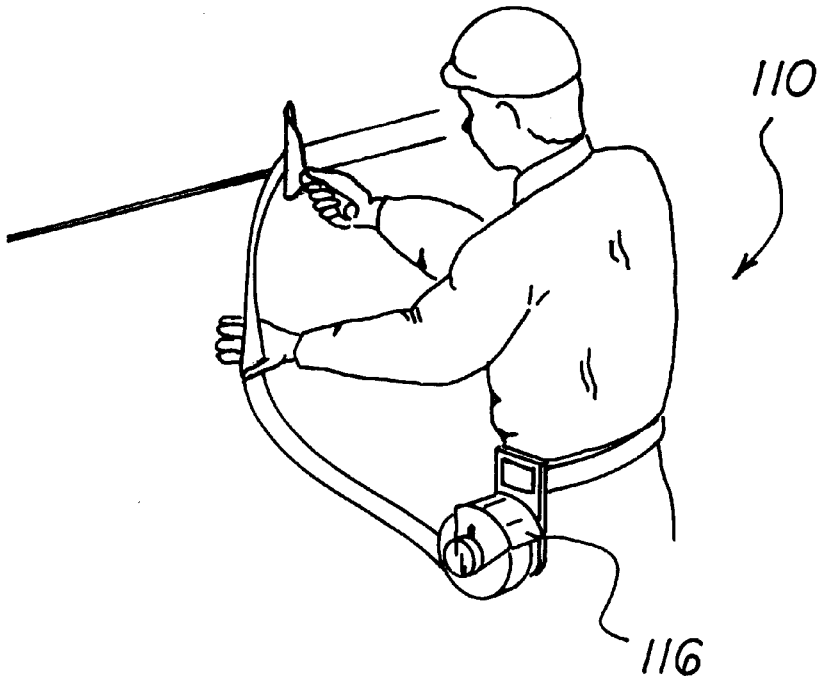
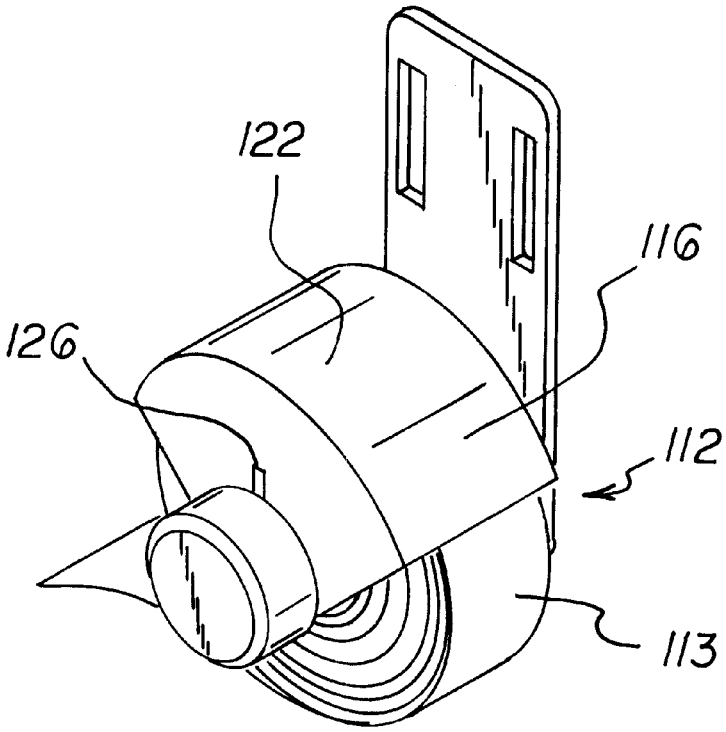
FIG. 8

114
113
130
120
140
132
134
126
116
112
124

TAPE DISPENSING DEVICE

CROSS REFERENCE TO RELATED APPLICATIONS

This application is a continuation-in-part of application Ser. No. 09/072,040 filed May 4, 1998 which is a continuation-in-part of application Ser. No. 08/818,925 filed Mar. 17, 1997, now abandoned which in turn is a continuation-in-part of application Ser. No. 08/546,815, filed Oct. 23, 1995, now abandoned. All of the above referenced applications are incorporated herein by reference.

BACKGROUND OF THE INVENTION

1. Field of the Invention

The present invention relates to a compound tape dispensing device, and more particularly pertains to a mechanism for the convenient holding and dispensing of a roll of tape.

2. Description of Related Art

The use of belt holders is known in the prior art. More specifically, belt holders heretofore devised and utilized for the purpose of supporting tools on a belt far easy access are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,508,691 to Langbehn discloses a belt tape reel holder for supporting coiled tape measures. U.S. Pat. No. Des. 317,984 to Reynoso et al. discloses the an ornamental design for a belt mountable tape dispenser formed from a unitary bent piece of wiring. U.S. Pat. No. 3,575,771 to Padgett discloses a tape dispenser for plasterboard junctions. U.S. Pat. No. Des. 275,527 to Gee discloses an ornamental design for a belt supported holder. U.S. Pat. No. Des. 250,919 to Milligan et al. discloses an ornamental design for a utility belt holster.

While these devices fulfill their respective, particular objectives and requirements, the aforementioned patents do not describe a compound tape dispensing device.

In this respect, the compound tape dispensing device according to the present invention substantially departs from the conventional concepts and designs of the prior art, and in so doing provides an apparatus primarily developed for the purpose holding and dispensing compound tape and further preventing the inadvertent unrolling thereof.

Therefore, it can be appreciated that there exists a continuing need for a new and improved compound tape dispensing device which can be used for holding and dispensing compound tape and further preventing the inadvertent unrolling thereof. In this regard, the present invention substantially fulfills this need.

SUMMARY OF THE INVENTION

In view of the foregoing disadvantages inherent in the known types of belt holders now present in the prior art, the present invention provides an improved compound tape dispensing device. As such, the general purpose of the present invention, which will be described subsequently in greater detail, is to provide a new and improved compound tape dispensing device which has all the advantages of the prior art and none of the disadvantages.

To attain this, the present invention essentially comprises a belt attachment portion comprised of a rigid rectangular portion having rounded corner portions. The rigid rectangular portion has a pair of elongated slots formed therethrough. The slots receive a belt therethrough for coupling therewith. The device includes a tape holding portion comprised of a cylindrical spool having a closed first end and an open second end. The closed second end is secured to the belt attachment portion by a pair of rivets extending through the rigid rectangular portion. The device includes a tape retaining portion comprised of a cap portion having a circular opening therein, The circular opening is adapted for securement over the open second end of the cylindrical spool for securement of a roll of compound tape upon the cylindrical spool. The device includes an unwinding prevention portion comprised of tack portion having a string secured to an end portion thereof. The string has a distal end secured to the tape retaining portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compound tape dispensing device which has all the advantages of the prior art belt holders and none of the disadvantages.

It is another object of the present invention to provide a new and improved compound tape dispensing device which may be easily and efficiently manufactured and marketed.

It is a further object of the present invention to provide a new and improved compound tape dispensing device which is of a durable and reliable construction.

An even further object of the present invention is to provide a new and improved compound tape dispensing device which is susceptible of a low cost of manufacture with regard to both materials and labor, and which accordingly is then susceptible of low prices of sale to the consuming public, thereby making such compound tape dispensing device economically available to the buying public.

Still yet another object of the present invention is to provide a new and improved compound tape dispensing device which provides in the apparatuses and methods of the prior art some of the advantages thereof, while simultaneously overcoming some of the disadvantages normally associated therewith.

Still another object of the present invention is to hold and dispense compound tape and further prevent the inadvertent unrolling thereof.

Lastly, it is an object of the present invention to provide a new and improved compound tape dispensing device comprised of a belt attachment portion. A tape holding portion is secured to the belt attachment portion. A tape retaining portion is secured to the tape holding portion to hold a roll of compound tape thereon.

An unwinding prevention portion is included to preclude the roll of compound tape from unrolling by applying a pressure on a circumferential face of the roll of compound tape.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a perspective illustration of an alternate embodiment of the present invention in use.

FIG. 8 is a perspective illustration depicting the alternate embodiment.

Similar reference characters refer to similar parts throughout the several views of the drawings.

DESCRIPTION OF THE PREFERRED EMBODIMENT

Figure 1:
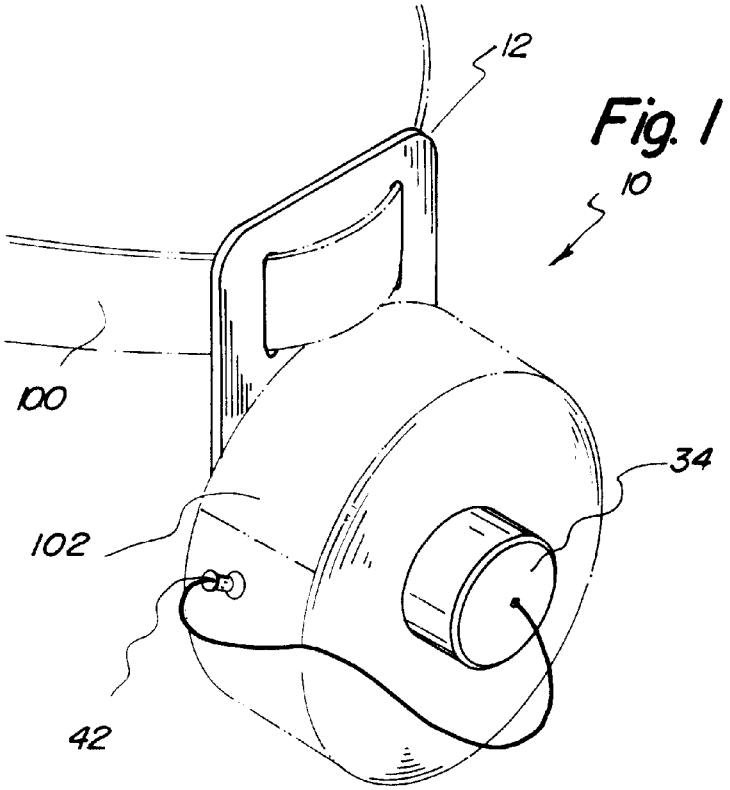
FIG. 1 is a perspective view of the preferred embodiment of the compound tape dispensing device constructed in accordance with the principles of the present invention.

With reference now to the drawings, and in particular to FIG. 1 thereof, a new and improved compound tape dispensing device embodying the principles and concepts of the present invention and generally designated by the reference numeral 10 will be described.

Specifically, it will be noted in the various Figures that the device relates to a new and improved compound tape dispensing device for holding and dispensing compound tape in a quicker and easier manner. In its broadest context, the device consists of a belt attachment portion, a tape holding portion, a tape retaining portion, and an unwinding prevention portion. Such components are individually configured and correlated with respect to each other so as to attain the desired objective.

First Embodiment (FIGS. 1–6)

Figure 2:
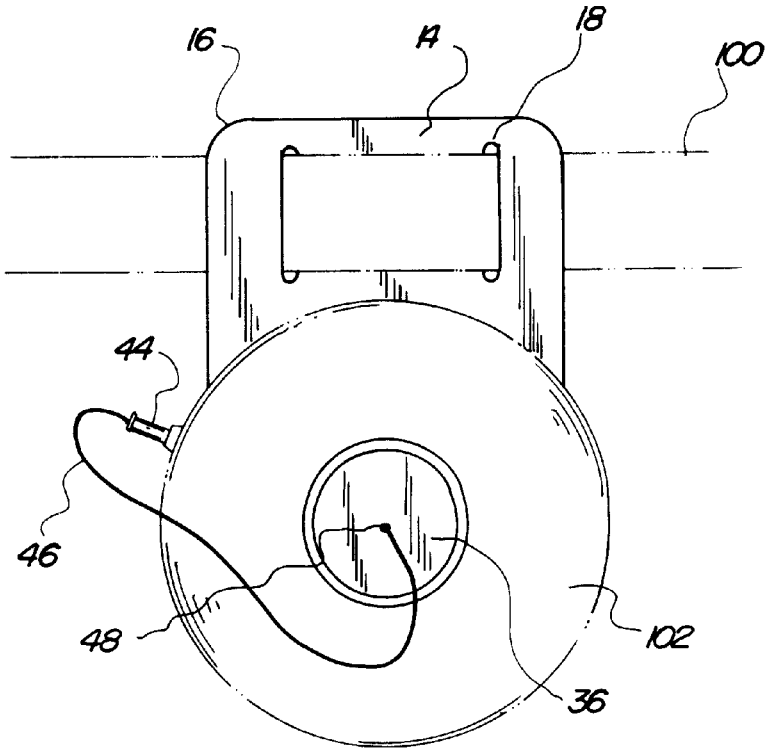
FIG. 2 is a front elevation view of the present invention.

The device 10 includes a belt attachment portion 12 comprised of a rigid rectangular portion 14 having rounded corner portions 16. The rigid rectangular portion 14 has a pair of elongated slots 18 formed therethrough. The slots 18 receive a belt 100 therethrough for coupling therewith. The belt attachment portion 12 can be fabricated of a rigid plastic or leather. FIG. 1 and FIG. 2 illustrate how the belt 100 is threaded through the elongated slots 18. The elongated slots 18 could be made in different lengths to accommodate belts with various sized widths.

Figure 5:
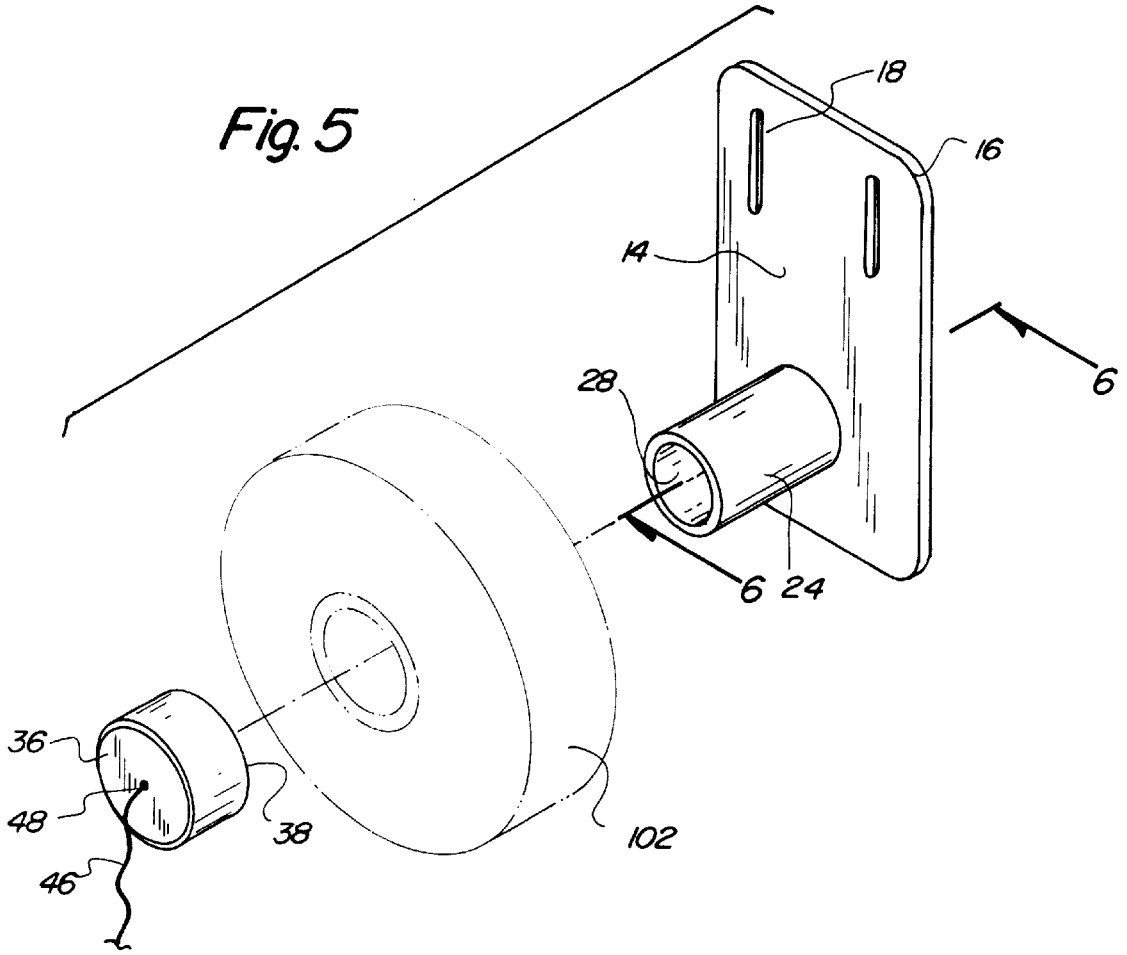
FIG. 5 is an exploded perspective view of the present invention.
Figure 6:
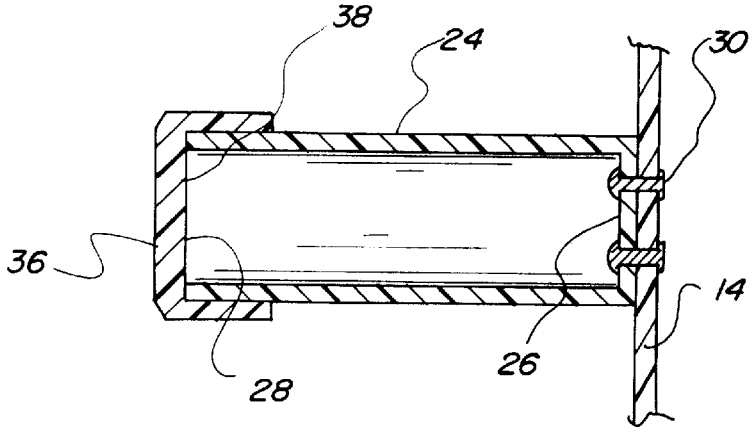
FIG. 6 is a cross-sectional view as taken along line 6-6 of FIG. 5.

The device 10 includes a tape holding portion 22 comprised of a cylindrical spool 24 having a closed first end 26 and an open second end 28. The closed second end 26 is secured to the belt attachment portion 12 by a pair of rivets 30 extending through the rigid rectangular portion 14. FIG. 6 illustrates the above mentioned coupling. The cylindrical spool 24 is fabricated of a rigid plastic material. The spool 24 is adapted to hold a roll of compound tape 102 thereon as illustrated in FIG. 5. The spool 24 is secured in an orthogonal relationship with respect to the belt attachment portion 12.

Figure 3:
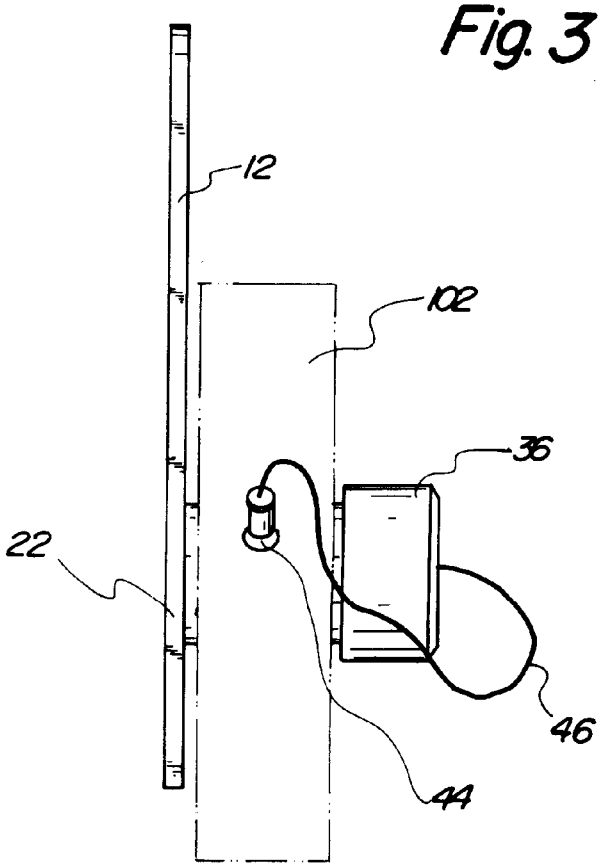
FIG. 3 is a side elevation view of the present invention.

The device 10 includes a tape retaining portion 34 comprised of a cap portion 36 having a circular opening 38 therein. The circular opening 38 is adapted for securement over the open second end 28 of the cylindrical spool 24 for securement of a roll of compound tape 102 upon the cylindrical spool 24. FIG. 3 illustrates a side view of the device 10 where the cap portion 36 retains the roll of compound tape 102 upon the cylindrical spool 24. The cap portion 36 can be fabricated of plastic or synthetic rubber. The cap portion 36 can be easily pulled off of the cylindrical spool 36 to allow the user to add or change the roll of compound tape 102.

Figure 4:
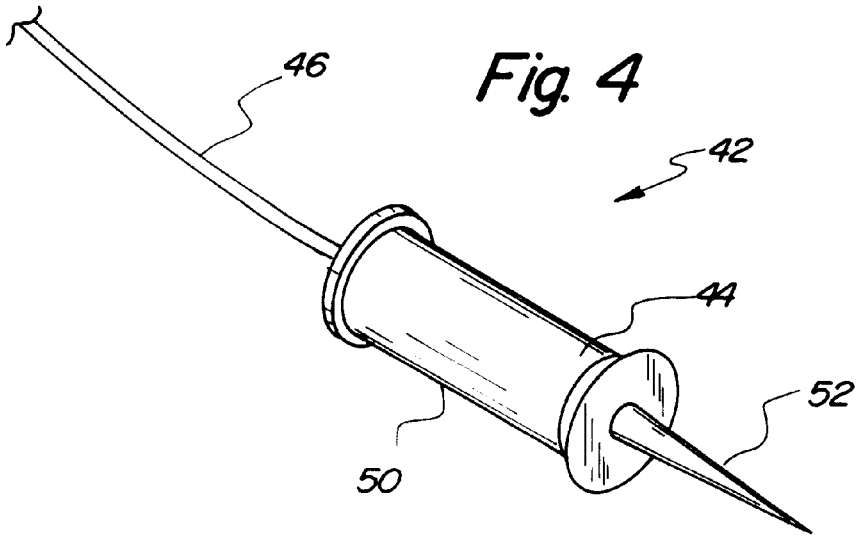
FIG. 4 is a perspective view of the unwinding prevention device of the present invention.

Lastly, the device 10 includes an unwinding prevention portion 42 comprised of tack portion 44 having a string 46 is cured to an end portion thereof. The string 46 has a distal end 48 secured to the tape retaining portion 34. The tack portion 44, as illustrated in FIG. 4, has a cylindrical body portion 50 having a sharpened pin portion 52 extending outwardly therefrom. Once a roll of compound tape 102 is unrolled, the tack portion 44 is used to be inserted into an end portion of the tape 102 to prevent it from unrolling while the user is working or attending to other matters.

Second Embodiment (FIGS. 7–11)

Figure 9:
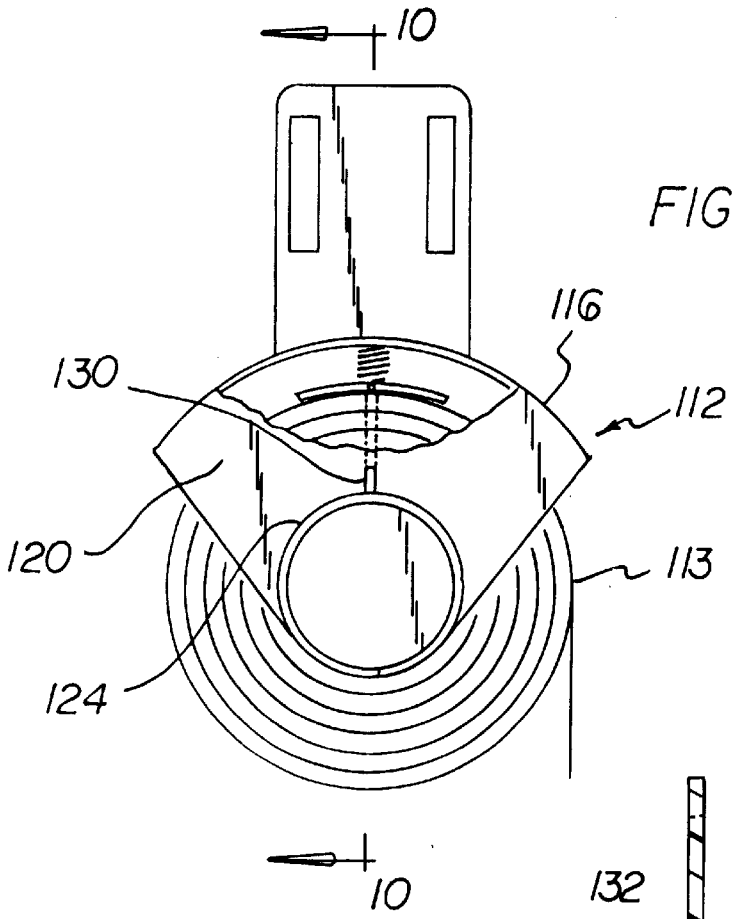
FIG. 9 is a front view of the alternate embodiment of the present invention.
Figure 10:
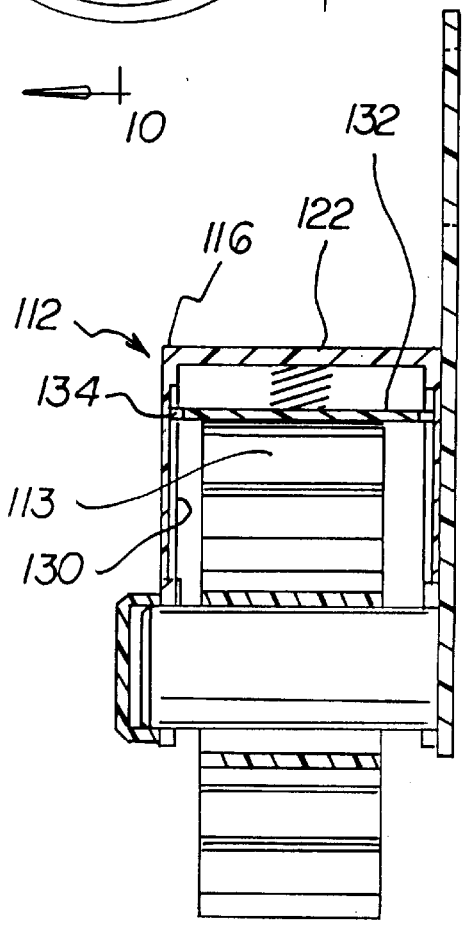
FIG. 10 is a cross-sectional view of the alternate embodiment of the present invention taken along line 10-10 shown in FIG. 9.
Figure 11:
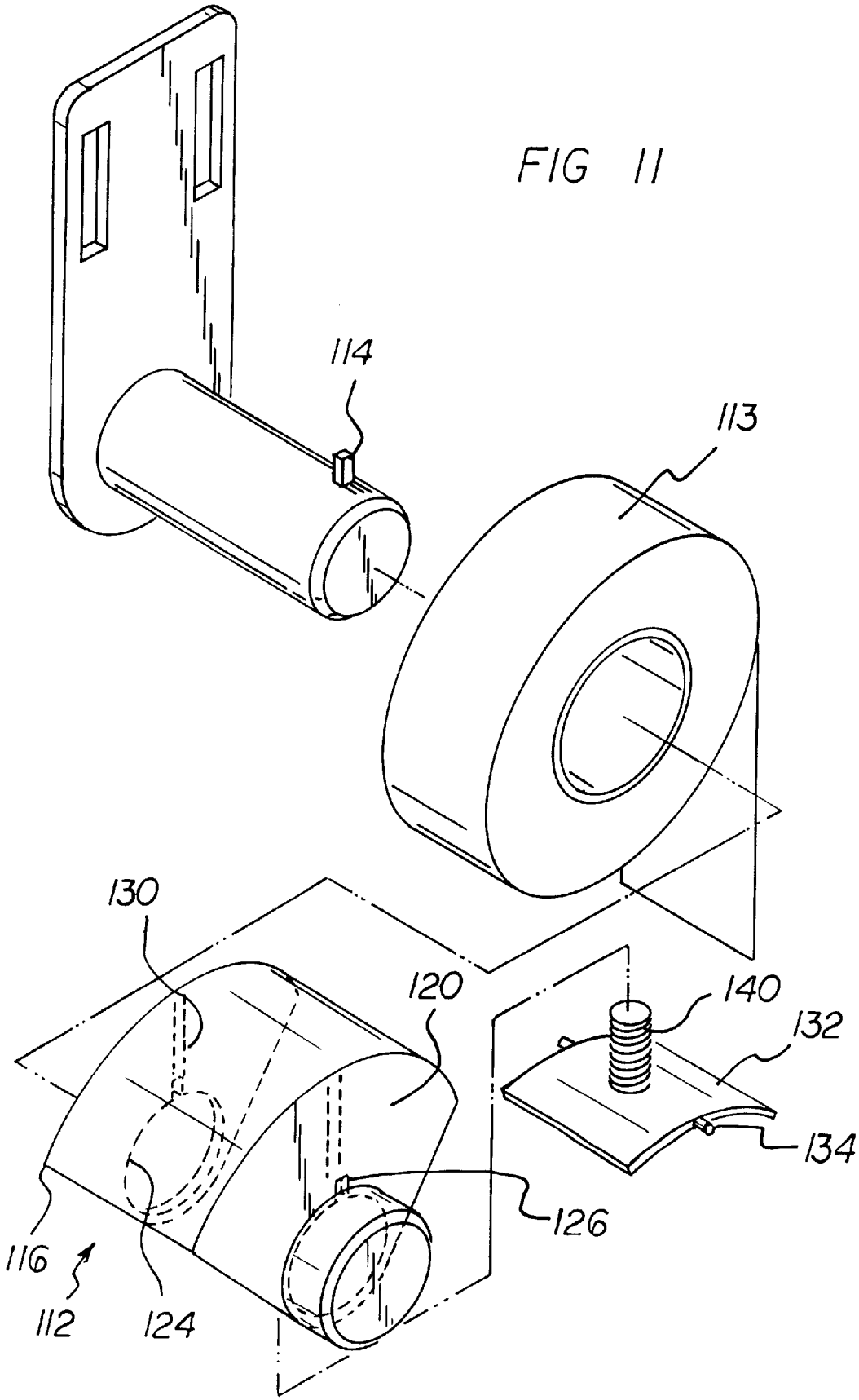
FIG. 11 is an exploded view of the alternate embodiment of the present invention.

As shown in FIGS. 7–11, an alternate embodiment 110 is disclosed wherein the unwinding prevention portion 112 is adapted for applying pressure on a circumferential face 113 of the roll of compound tape. A rectangular tab 114 is formed adjacent the second end of the cylindrical spool and extends upwardly therefrom. The space between the second end and the placement of the tab is equal to the width of the cap portion. The unwinding prevention means of the alternate embodiment further includes a cover 116 having a pair of side faces 120 and a top arcuate face 122. Each side face has a generally triangular configuration with a pair of linear edges and an arcuate edge. Coaxial apertures 124 are formed in the side faces adjacent an apex defined by the linear edges thereof. Such apertures are for allowing the cover to be slidably situated on the cylindrical spool. As shown in FIG. 10, the apertures of one of the side faces has a notch 126 formed therein for engaging the tab when the present invention is in its operative orientation thereby maintaining the cover above the cylindrical spool at all times.

For reasons that will become apparent later, the cover of the alternate embodiment further has a pair of elongated linear inset portions 130 formed vertically on an interior surface of the side faces thereof. As best shown in FIG. 9, the cover encompasses ⅓ of a periphery of the roll of compound tape thereby defining an arc of approximately 120 degrees.

Yet a further component of the unwinding prevention means of the present embodiment is a spring biased pressure plate 132 adapted to apply pressure to a circumferential face of the roll of compound tape. The pressure plate is rectangular and arcuate. The plate preferably defines an arc of approximately 40 degrees. Side edges of the pressure plate have protrusions 134 extending outwardly therefrom for slidably coupling within the inset portions of the side faces of the cover. It should be noted that the inset portions terminate at a lower end thereof for preventing the pressure plate from being removed therefrom. It should further be understood that the inset portions and the protrusions have square cross-sections for maintaining the circle associated with the arc of the pressure plate remains in coaxial relationship with the circle associated with the arc of the top face of the cover. Lastly, a spring 140 is coupled between an interior surface of the top face of the cover and a top face of the pressure plate. As such, the direction of the pressure applied by the pressure plate is along an axis which is perpendicular to an axis of the cylindrical spool. During use of the alternate embodiment, a user first places the roll of tape in coaxial relation with the apertures of the cover thus biasing the pressure plate upwardly. Next, the roll of tape and the cover are situated on the cylindrical spool with the tab and the notch engagement. Finally, the cap portion is placed on the second end of the cylindrical spool.

Third Embodiment (FIGS. 12–15)

The alternate embodiment of FIGS. 12–15 will now be set forth. Such embodiment includes a housing 200 with a front planar face and a rear planar face each having a periphery. Such periphery is defined by a broad semi-circular top edge, a pair of linear converging side edges, and a tight semi-circular bottom edge. The front face and the rear face of the housing each has a rectangular tab 214 coupled to the bottom edge thereof and extended downwardly therefrom in coplanar relationship therewith.

Figure 13:
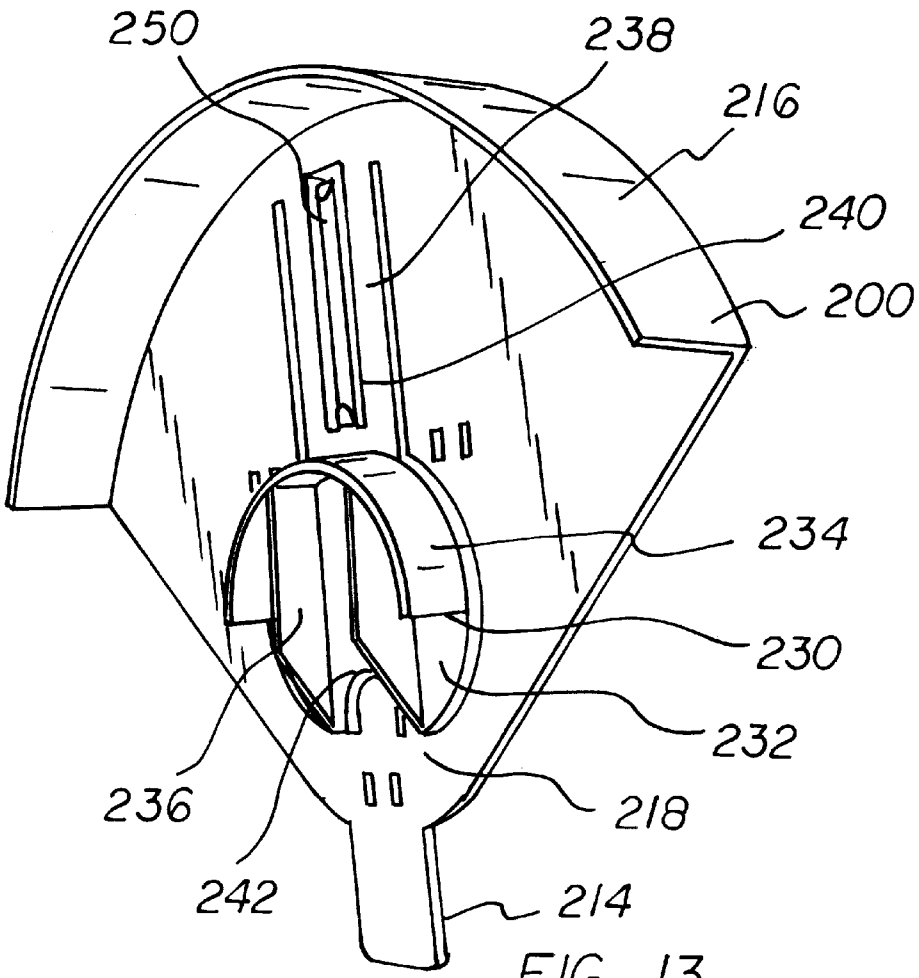
FIG. 13 is a front perspective of a front half of the embodiment of FIG. 12.
Figure 12:
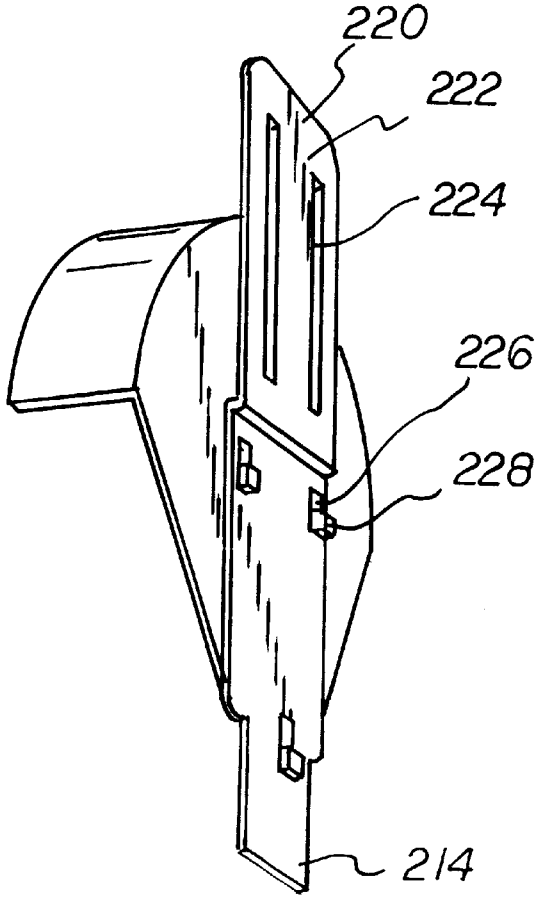
FIG. 12 is a rear perspective view of a rear half of another alternate embodiment of the present invention.
Figure 15:
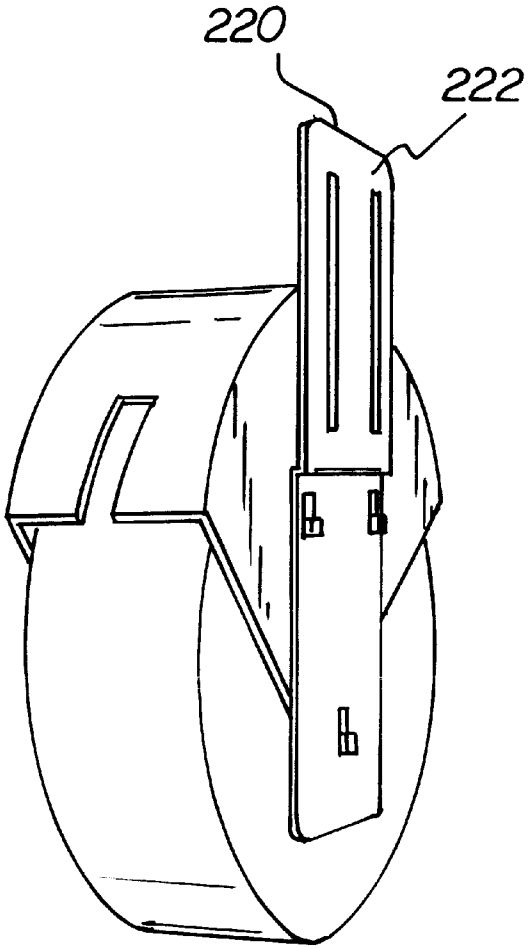
FIG. 15 is a rear perspective view of the embodiment of FIGS. 12 & 13 during use.

The housing further includes a top face defined by a portion of a cylinder with a pair of side edges integrally coupled to the top edges of the front and rear planar faces of the housing. The top face is preferably coupled to the front and rear faces in perpendicular relationship therewith for defining an interior space. For reasons that will become apparent, the front and rear planar faces each have a circular hole 218 formed therein adjacent to the bottom edge thereof. As shown in FIGS. 12 & 13, the housing may be constructed as a pair of halves that may be coupled by any desired means.

Next provided is a belt holder 220 which is removably coupled to the rear face of the housing. The belt holder includes a rectangular plate 222 with a top extent having a pair of vertically oriented, parallel slots 224 formed therein. Such slots serve for passing a belt therethrough. The rectangular plate of the belt holder further has a bottom extent residing in a plane which is offset with respect to the top extent.

It should be noted that the bottom extent of the rectangular plate is removably coupled to either face of the housing by way of a plurality of protrusion and slot combinations. It should be understood that the face to which the belt holder is attached is defined as the rear face.

As shown in FIGS. 12–15, the slots 226 of the belt holder include a large upper portion and a small lower portion. Further, the protrusions 228 include a large outboard portion and a small inboard portion. By this structure, the protrusions may each be inserted within the large upper portion of one of the slots and slid downwardly such that the small inboard portion of the protrusion engages the small lower portion of the slot. In the preferred embodiment, the protrusions are mounted on an outer surface of each face about the associated hole in a triangular configuration.

Both the front and rear face of the housing each has a tape engagement portion 230 that includes a circular plate 232 with an inwardly extending, semi-annular lip 234 coupled thereto. The semi-annular lip of each tape engagement portion is preferably defined by a portion of a cylinder. A pair of vertically oriented supports 236 are integrally coupled to an inner surface of each of the circular plates for supporting the semi-annular lip. Note FIG. 13. As shown in such Figure, the plate of each tape engagement portion is coupled to the housing via a spring member 238 and is situated within the hole of the corresponding face.

The spring member of the tape engagement portion includes a rectangular strip 240 situated within a rectangular cut out formed in the housing. Such rectangular cut out is situated above the hole of the corresponding face and is vertically oriented. The strip has a top edge integrally coupled to a top edge of the cut out for affording a resilient living hinge. It should be noted that in their rest positions, the strip of the string member and the circular plate remain in coplanar relationship. For allowing the selective biasing of each circular plate outwardly against the force of the spring member, the plate of the tape engagement portion includes a cut out 242 formed in a bottom end thereof. This feature is critical for allowing a user to bias both tape engagement portions to allow a user to insert a roll of tape between the semi-annular lips thereof for dispensing purposes.

Figure 14:
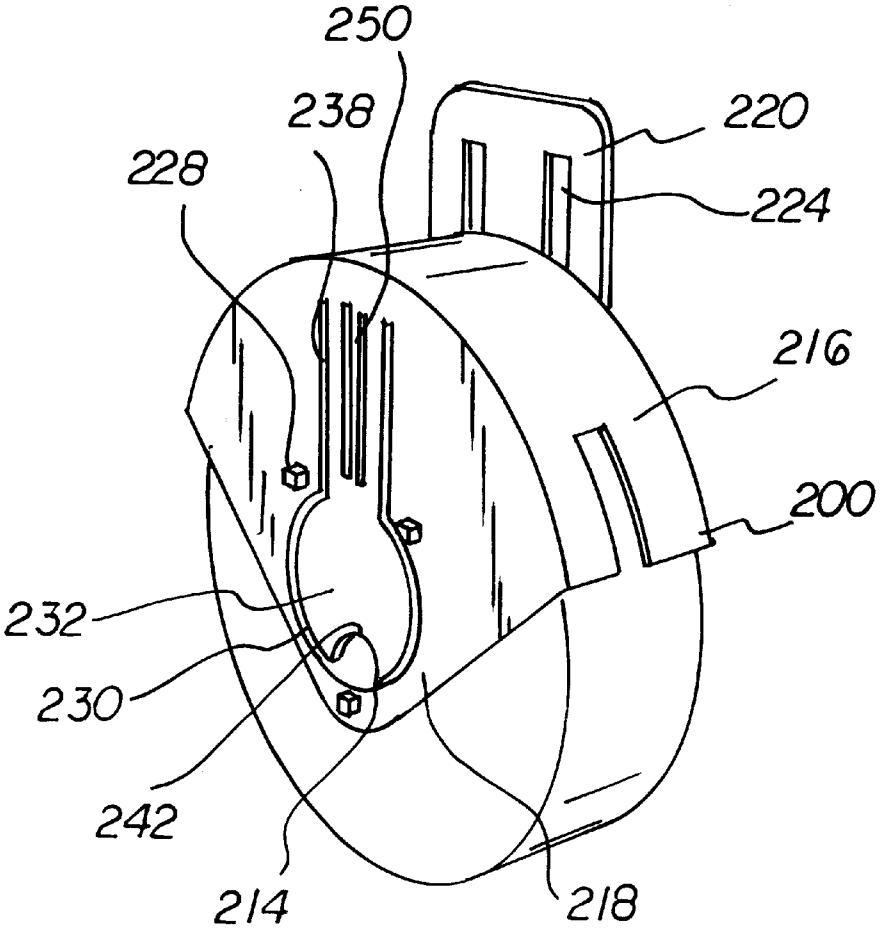
FIG. 14 is a front perspective view of the embodiment of FIGS. 12 & 13 during use.
Figure 16:
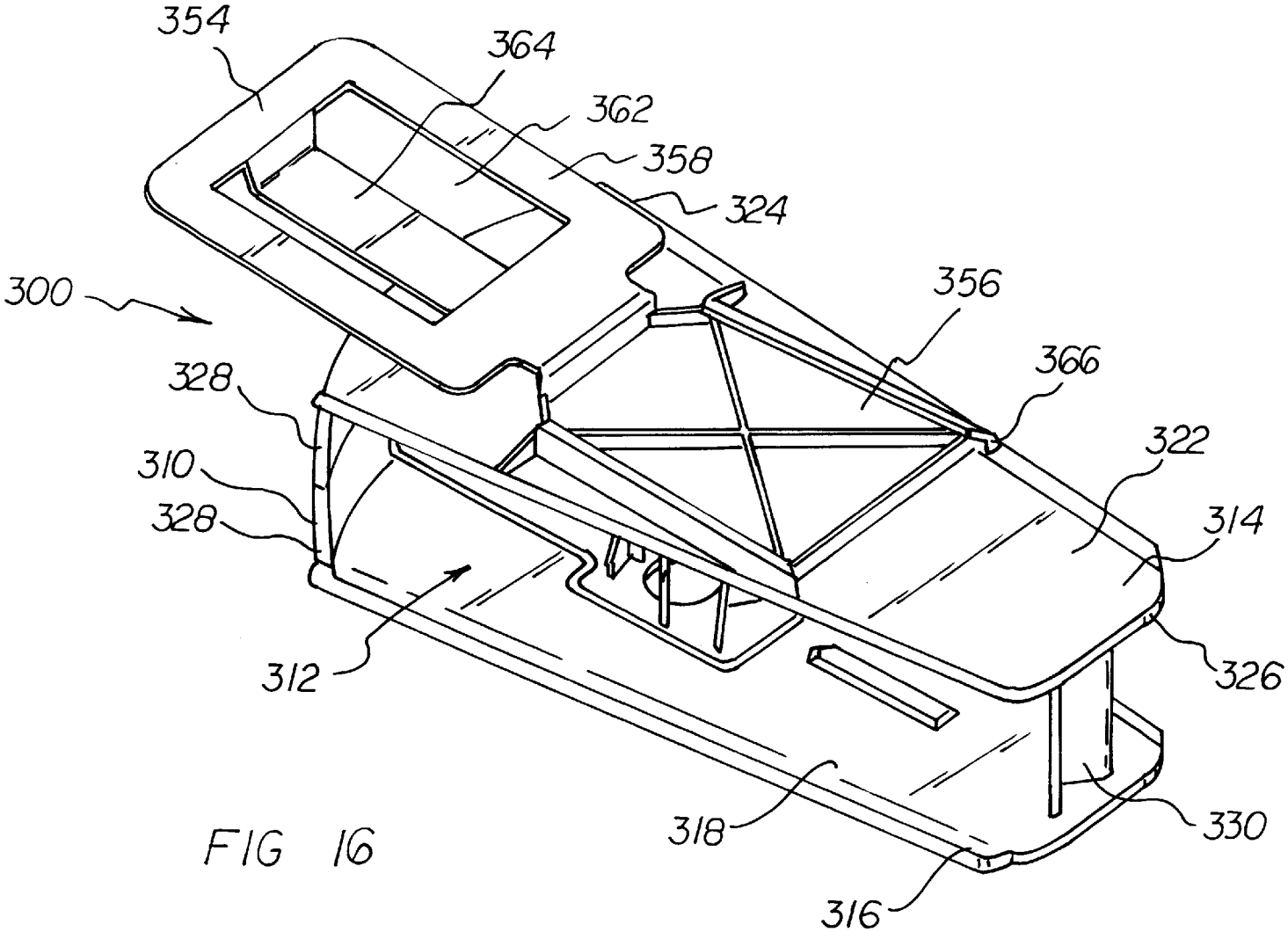
FIG. 16 is a perspective view of yet another embodiment of the tape dispenser of the present invention.
Figure 17:
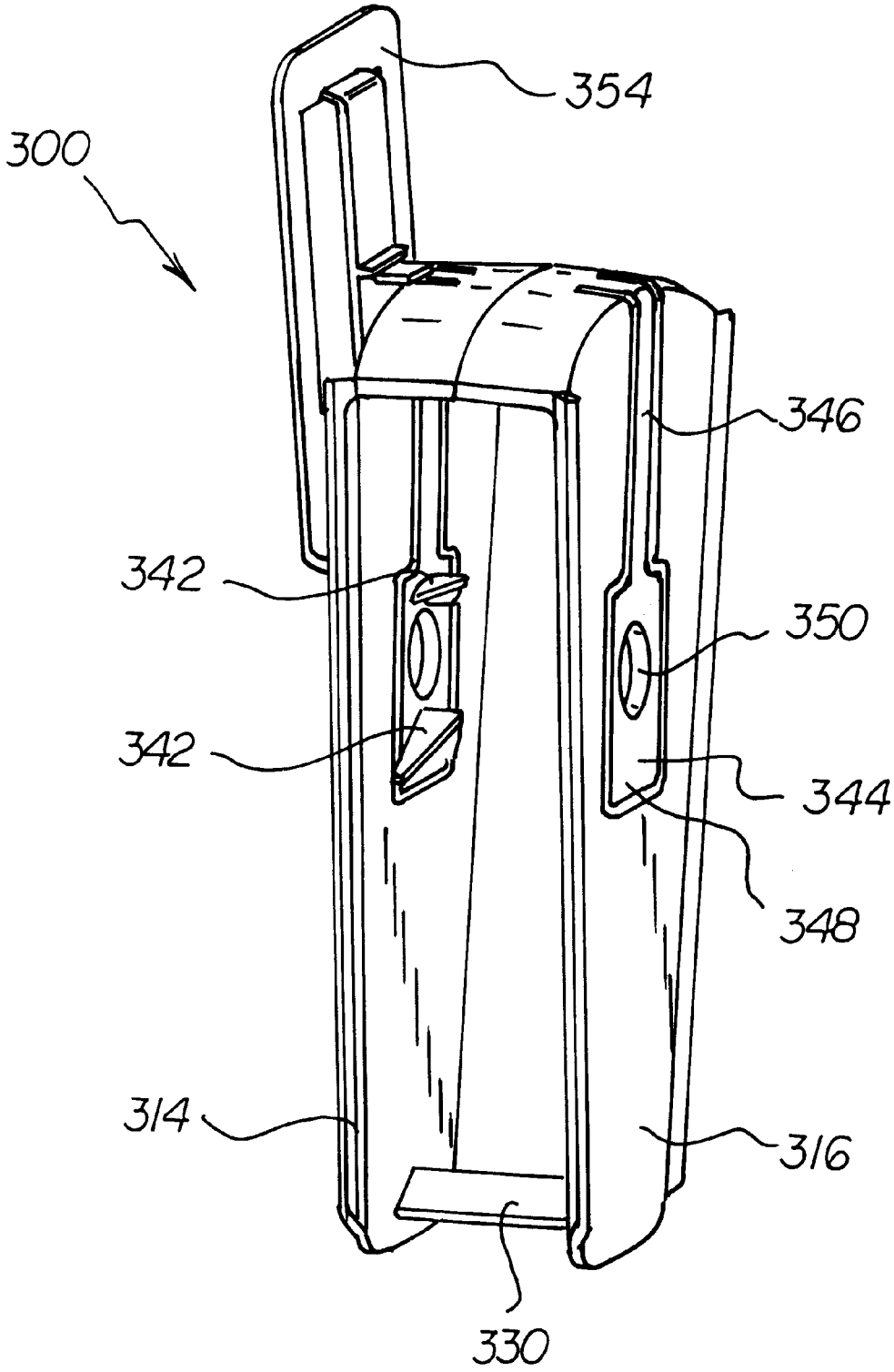
FIG. 17 is a perspective of the dispenser of FIG. 16.

For holding an end of the roll of tape, the spring member has a small rectangular strip 250 situated within a small rectangular cut out formed therein. As shown in FIGS. 13 & 14, the small strip is coupled to a bottom edge of the associated small rectangular cutout. A height of the small rectangular strip is preferably similar to that of the rectangular strip of the spring member. As an option, a pair of slots may be formed in the top face of the housing adjacent to end edges thereof for allowing an end of the roll of tape to be situated therethrough. This feature would serve as a supplementary means of maintaining the end of the roll of tape in place.

Fourth Embodiment (FIGS. 16–19)

The fourth embodiment is illustrated with reference to FIGS. 16–19. These Figures depict a tape retaining and dispensing device which is designed to easily accept and retain a roll of tape.

Figure 18:
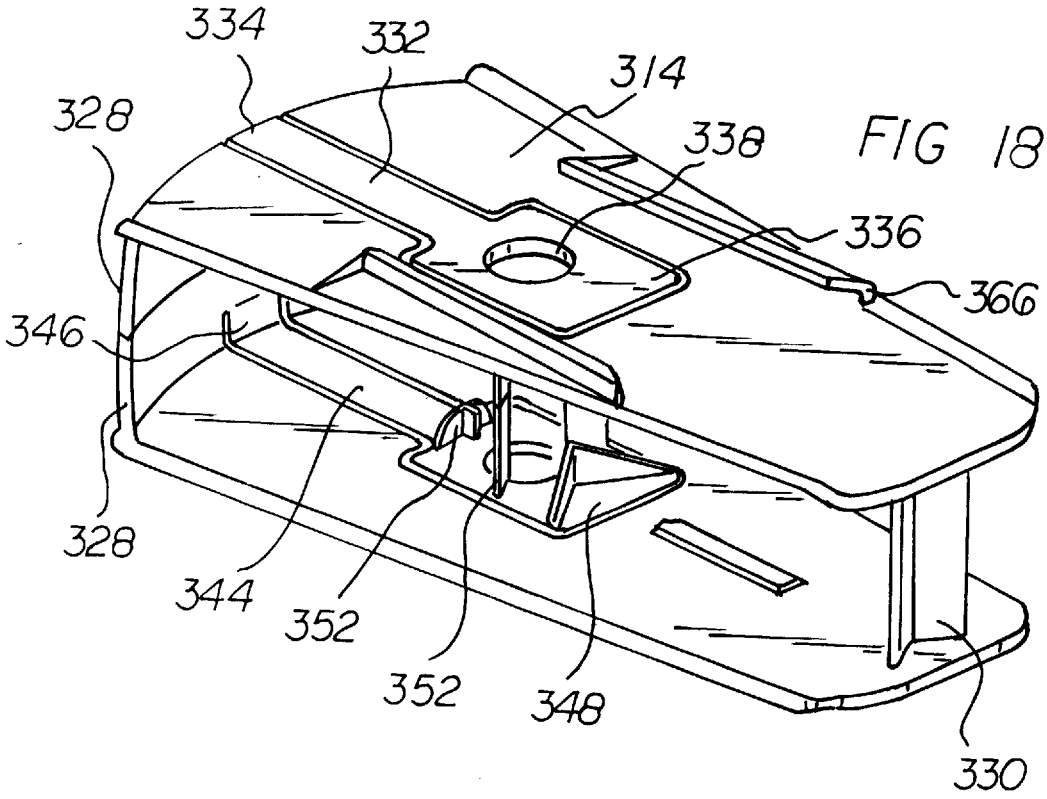
FIG. 18 is a perspective view of the dispenser of FIG. 16 with the belt holder removed.

The device 300 includes a housing 310 with a hollow interior portion 312. This housing 310 is formed by first and second housing components, 314 and 316 respectively. Each of these housing components is formed from a wall, preferably of plastic. Each component is defined by inner and outer surfaces (318 and 322) as well as by rounded upper and lower ends (324 and 326). As illustrated in FIG. 18, the upper end 324 of each housing component is larger than the lower end 326. Thus, the entire housing 310 is wedge shaped. Each of the housing components further includes an arcuate edge 328 which is coupled to its upper rounded end. In the preferred embodiment, the upper rounded edge 328 is formed integrally with the remainder of the component. Each of the arcuate edges 328 of the housing components are joined together. Through such interconnection the major housing 310 is formed.

A bridge 330 also serves to interconnect the two housing components, 314 and 316. Specifically, the lower ends of the first and second housing components are joined by a angled structural element to give added rigidity to the entire device. Preferably, the width of the structural element 330 and the width of the arcuate edges 328 is chosen such that tape rolls of various sizes can be accommodated within the hollow interior 312 of the housing 310.

Each of the housing components 314 and 316 includes a cutout formed through its thickness. These cut outs form living hinges which serve to resiliently retain a roll of tape in a manner more fully described hereinafter. The first living hinge 332 is formed by a channel within the first housing component 314. This hinge 332 is defined by upper and lower extents, 334 and 336 respectively. The upper extent 334 is secured to the remainder of the housing. Preferably, the upper extent 334 is integral with the arcuate edge 328 of the housing, note FIG. 17. The lower free extent 336 of the hinge preferably includes a thumb hole 338 formed through its thickness. The thumb hole 338 enables a user to grasp the lower extent 336 of the hinge 332 and bend it upwardly out of the plane of the housing component 314. A series of tape retaining flanges 342 are integrally formed upon the inner surface of the lower extent of the hinge 332. The function of the flanges 342 will be described in greater detail hereinafter.

The second living hinge 344 (or cutout) is similar to the first. Namely, the second living hinge 344 is formed by a channel within the second housing component. The hinge is similarly defined by an upper extent 346 secured to the remainder of the housing and a lower extent 348. A thumb hole 350 is preferably formed within the lower extent 348. Additionally, a series of tape retaining flanges 352 are formed upon the inner surface of the lower extent 348 of the hinge 344. As with the first hinge 332, the second hinge 344 is resilient and flexible and capable of being bent out of the plane of the surrounding housing component.

Each of the retaining flanges takes the form of truncated, angled pieces. In the preferred embodiment, there are two to three such pieces surrounding the inner surface of either thumb hole. Ideally, the flanges have a depth which allows them to securely engage the interior of a tape roll. However, the flanges are not so deep as to preclude a roll of tape from being inserted within side of the device with the hinges bent outwardly. Thus, in use, a user engages one or more thumb holes to urge the hinges outwardly. Such engagement provides enough clearance to permit a roll of tape to be inserted between the two housing components. Once the spool of the tape is centered upon the opposing tape retaining flanges, the hinges are free to snap back into place. Thereafter, the spool can freely rotate upon the retaining flanges and tape can be conveniently dispensed from either side of the housing.

Figure 19:
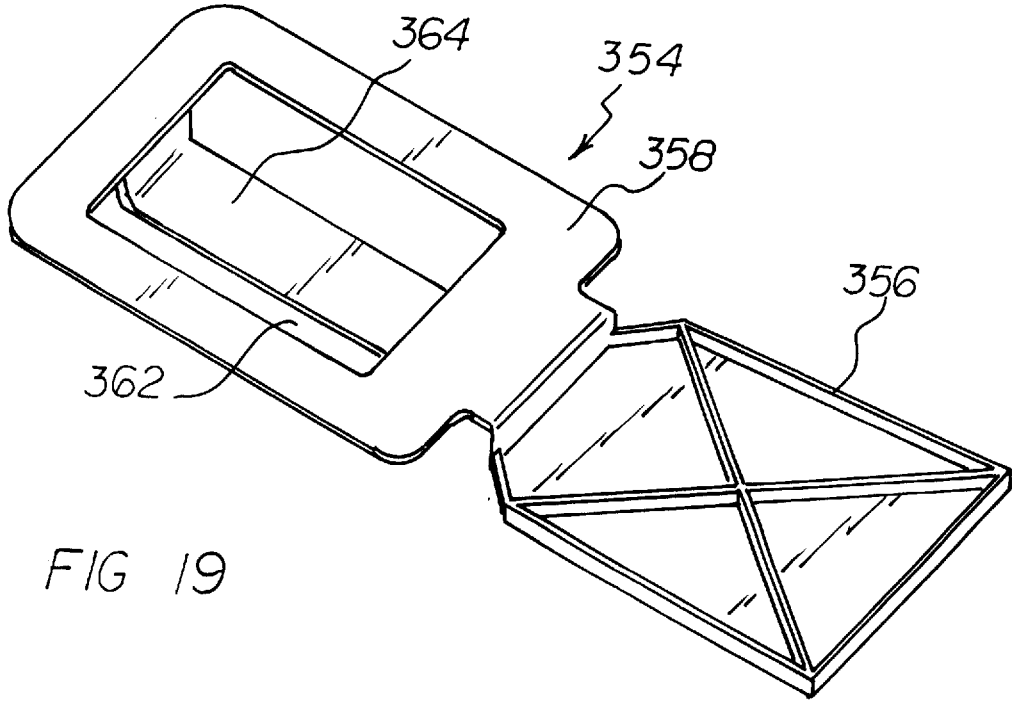
FIG. 19 is a perspective view of the belt holder used in conjunction with the dispenser of FIGS. 16–17.

For ease in carrying the device, a belt clip 354 is included. As illustrated in FIG. 19, the retaining clip 354 is defined by a lower extent 356 and an upper extent 358. In the preferred embodiment, the lower extent 356 is integral with, but offset from, the upper extent 358. Additionally, the upper extent 358 has a rectangular cut out 362 formed through its thickness and a belt retaining element 364 secured thereover. A belt is adapted to be threaded in between the retaining element 364 and the remainder of the clip 354. The lower extent 356 of the clip 354 is adapted to be removably secured to one of the housing components of the device. In the preferred embodiment, a pair of channels 366 are formed upon the outer surface 322 of the first housing component 314, note FIG. 18. The lower extent 356 of the clip 354 is then designed to be slidably interconnected to the channels 366 of the first housing component 314, note FIG. 16.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts Of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, ail suitable modifications and equivalents may be resorted to, falling within the scope of the invention.

What is claimed is:

1. A tape holder comprising, in combination:

a roll of tape;

a housing including a front face and a rear face each having a periphery defined by an elongated semi-circular top edge, a pair of converging side edges, and a narrow semi-circular bottom edge, the housing further including a top face defined by a portion of a cylinder with a pair of side edges integrally coupled to the top edges of the front and rear planar faces in perpendicular relationship therewith for defining an interior space, the front and rear planar faces each having a hole formed therein adjacent to the bottom edge;

a belt holder removably coupled to the rear face of the housing; and tape engagement portion situated within at least one of the holes of the housing for releasably engaging a center aperture of the roll of tape;

wherein the belt holder includes a rectangular plate with a top extent having a pair of vertically oriented, parallel slots formed therein; and wherein the rectangular plate has a bottom extent residing in a plane which is offset with respect to the top extent; and wherein the bottom extent of the rectangular plate is removably coupled to the rear face of the housing by way of a plurality of protrusion and slot combinations.

2. A tape holder as set forth in claim 1 wherein the tape engagement portion includes at least one plate with an inwardly extending lip coupled thereto, wherein the plate is coupled to the housing and situated within one of the holes via a spring member.

3. A tape holder comprising, in combination:

a roll of tape;

a housing including a front face and a rear face each having a periphery defined by an elongated semi-circular top edge, a pair of converging side edges, and a narrow semi-circular bottom edge, the housing further including a top face defined by a portion of a cylinder with a pair of side edges integrally coupled to the top edges of the front and rear planar faces in perpendicular relationship therewith for defining an interior space, the front and rear planar faces each having a hole formed therein adjacent to the bottom edge;

a belt holder removably coupled to the rear face of the housing; and tape engagement portion situated within at least one of the holes of the housing for releasably engaging a center aperture of the roll of tape;

wherein the front face and the rear face of the housing each has a rectangular tab coupled to the bottom edge thereof and extended downwardly therefrom in coplanar relationship therewith.

4. A tape holder comprising, in combination:

a roll of tape;

a housing including a front face and a rear face each having a periphery defined by an elongated semi-circular top edge, a pair of converging side edges, and a narrow semicircular bottom edge, the housing further including a top face defined by a portion of a cylinder with a pair of side edges integrally coupled to the top edges of the front and rear planar faces in perpendicular relationship therewith for defining an interior space, the front and rear planar faces each having a hole formed therein adjacent to the bottom edge;

a belt holder removably coupled to the rear face of the housing; and tape engagement portion situated within at least one of the holes of the housing for releasably engaging a center aperture of the roll of tape;

wherein the tape engagement portion includes at least one plate with an inwardly extending lip coupled thereto, wherein the plate is coupled to the housing and situated within one of the holes via a spring member;

wherein the spring member includes a strip situated within a cut out formed in the housing and situated above the hole, the strip further coupled to a top edge of the cut out, wherein the strip of the spring member and the circular plate remain in coplanar relationship.

5. A compound tape dispensing device comprising:

a belt worn by a user;

a roll of compound tape;

a belt attachment comprising a rigid rectangular portion for coupling with the belt;

a tape holder secured to the belt attachment comprising a cylindrical spool having a first end and a second end;

an unwinding prevention means for preventing the unwinding of the tape, the unwinding prevention means adapted for applying a pressure on a circumferential face of the roll of compound tape;

wherein the cylindrical spool has a tab formed adjacent the second end thereof and extended upwardly therefrom and the unwinding prevention means further includes a cover having an arcuate top face and a pair of side faces with coaxial apertures formed therein adjacent an apex thereof for allowing the cover to be slideably situated on the cylindrical spool wherein the cover encompasses ⅓ of a periphery of the roll of compound tape, wherein one of the side faces has a notch formed therein for engaging the tab thereby maintaining the cover above the cylindrical spool;

wherein the unwinding prevention means includes a pair of elongated linear inset portions formed vertically on an interior surface of the side faces of the cover which terminate adjacent a lower end of the cover and a spring biased plate adapted to apply pressure to the circumferential face of the roll of compound tape with a direction of the pressure being along an axis which is perpendicular to an axis of the cylindrical spool, the plate being rectangular, arcuate and defining an arc of about 40 degrees, the plate having a pair of protrusions extending outwardly therefrom for slideably coupling within the inset portions of the cover, a spring interconnected with the plate being coupled between an interior surface of the top face of the cover and a top face of the plate for biasing the plate against an outer convolution of the compound tape, wherein the inset portions and the protrusions each have a square cross-section for maintaining a circle associated with the arc of the plate in parallel relationship with the top face of the cover.

6. A compound tape dispensing device comprising:

a belt attachment for receiving a belt worn by a user therethrough for coupling therewith;

a tape holder secured to the belt attachment; and an unwinding preventor, wherein the unwinding preventor comprises a tack having a string secured to an end portion of the tape holder, whereby the tack is inserted into a length of tape.

7. A tape retaining and dispensing device comprising:

first and second housing components, each of the housing components being formed from a wall having inner and outer surfaces and rounded upper and lower ends, the upper end of each the housing component being larger than the lower end, each of the housing components further including an arcuate edge coupled to the upper rounded end, the arcuate edges of the first and second housing components being joined together such that housing is formed;

a bridge interconnecting the lower ends of the first and second housing components;

a pair of channels formed upon the outer surface of the first housing component;

a first hinge located within the channel of the first housing component, the hinge having an upper extent secured to the remainder of the housing and a lower extent with a thumb hole formed therein, a series of tape retaining flanges formed upon the inner surface of the lower extent of the hinge, the hinge being flexible and capable of being bent out of the plane of the housing component;

a second hinge located within the channel of the second housing component, the hinge having an upper extent secured to the remainder of the housing and a lower extent with a thumb hole formed therein, a series of tape retaining flanges formed upon the inner surface of the lower extent of the hinge, the hinge being flexible and capable of being bent out of the plane of the housing component;

a belt retaining clip having a lower extent which is integral with but offset from an upper extent, the upper extent having a rectangular cut out formed through its thickness and a belt retaining element secured thereover, the lower extent of the clip being slidably interconnected to the channels of the first housing component.

8. A tape retaining and dispensing device comprising:

first and second housing components, each of the housing components being formed from a wall having inner and outer surfaces and upper and lower ends, each of the housing components further including an edge coupled to the upper end, the edges of the first and second housing components being joined together such that housing is formed;

a first hinge formed within the first housing component, the hinge having an upper extent secured to the remainder of the housing and a lower extent, a series of retaining flanges formed upon the inner surface of the lower extent of the hinge;

a second hinge formed within the second housing component, the hinge having an upper extent secured to the remainder of the housing and a lower extent, a series of retaining flanges formed upon the inner surface of the lower extent of the hinge;

a belt retaining clip having a lower extent and an upper extent, the lower extent of the clip being interconnected to the first housing component.

9. The tape dispensing device as detailed in claim 8 wherein each of the hinges is flexible and capable of being bent out of the plane of its associated housing component.

10. The tape dispensing device as detailed in claim 8 wherein the lower extent of the belt retaining clip is offset from the upper extent.

11. The tape dispensing device as detailed in claim 8 wherein each of the hinges has a thumb hole formed through its lower extent.

12. A tape retaining and dispensing device comprising:

first and second housing components, each of the housing components being formed from a wall having inner and outer surfaces and upper and lower ends, each of the housing components further including an edge coupled to the upper end, the edges of the first and second housing components being joined together such that housing is formed;

a first cutout formed within the first housing component, the cutout having an upper extent secured to the remainder of the housing and a lower free extent;

a second cutout formed within the second housing component, the cutout having an upper extent secured to the remainder of the housing and a lower free extent.

* * * * *